US006328095B1

(12) United States Patent
Felber et al.

(10) Patent No.: US 6,328,095 B1
(45) Date of Patent: Dec. 11, 2001

(54) HEAT RECOVERY VENTILATOR WITH MAKE-UP AIR CAPABILITY

(75) Inventors: Steven M. Felber, Eagan; Timothy J. Kensok, Minnetonka; Ron S. Ragland, Minneapolis; Leisha J. Rotering, Minneapolis; Timothy J. Smith, Minneapolis; Russell A. Straate, Plymouth; Brad A. Terlson, Maple Grove, all of MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/518,923

(22) Filed: Mar. 6, 2000

(51) Int. Cl.[7] ..... F25B 29/00; F24H 3/02
(52) U.S. Cl. ..... 165/54; 165/8; 165/222
(58) Field of Search ..... 165/6, 7, 8, 48.1, 165/54, 279, 281, 222

(56) References Cited

U.S. PATENT DOCUMENTS

| | | | | |
|---|---|---|---|---|
| 2,700,537 | | 1/1955 | Pennington . | |
| 3,125,157 | | 3/1964 | Munters et al. . | |
| 4,513,809 | | 4/1985 | Schneider et al. . | |
| 4,887,438 | | 12/1989 | Meckler . | |
| 5,069,272 | * | 12/1991 | Chagnot | 165/8 |
| 5,078,208 | * | 1/1992 | Urch | 165/54 X |
| 5,183,098 | * | 2/1993 | Chagnot | 165/8 |
| 5,238,052 | * | 8/1993 | Chagnot | 165/8 |
| 5,373,704 | | 12/1994 | McFadden . | |
| 5,426,953 | * | 6/1995 | Meckler | 165/8 X |
| 5,732,562 | * | 3/1998 | Moratalla | 165/8 X |
| 5,761,915 | | 6/1998 | Rao . | |
| 5,826,641 | * | 10/1998 | Bierwirth et al. | 165/54 X |
| 5,829,513 | * | 11/1998 | Urch | 165/54 |
| 5,839,288 | | 11/1998 | Dotson . | |
| 6,029,467 | * | 2/2000 | Moratalla | 165/8 X |
| 6,131,653 | * | 10/2000 | Larsson | 165/54 X |
| 6,141,979 | * | 11/2000 | Dunlap | 165/8 X |

FOREIGN PATENT DOCUMENTS

| | | |
|---|---|---|
| 2134168 | 5/1995 | (CA) . |
| 4-143538 | 5/1992 | (JP) . |

* cited by examiner

*Primary Examiner*—Ira S. Lazarus
*Assistant Examiner*—Ljiljana V. Ciric

(57) ABSTRACT

A ventilation system for ventilating fresh air to a conditioned space, the system capable of supplying substantially more air to the space than is removed by the system in order to prevent depressurization inside the space. Passing through the unit housing is an inflow chamber, an outflow chamber, and a make-up air duct. Two blowers, an intake blower and an exhaust blower, are placed within the inflow chamber and the outflow chamber in order to motivate inflow and outflow currents of air. A damper acts to open and close the make-up air duct. When the damper is in an open position and the intake blower operates at a higher speed than the exhaust blower the system increases the air pressure within the conditioned space. A heat transfer wheel is disposed within both the inflow chamber and the outflow chamber to exchange heat between the two currents of air. A pre-heater is placed in the make-up air duct to be used in cold weather conditions to heat the air which bypasses the heat recovery wheel. The system can also include a desiccant wheel and regenerative heater in order to provide the function of dehumidification.

13 Claims, 1 Drawing Sheet

HEAT RECOVERY VENTILATOR WITH MAKE-UP AIR CAPABILITY

Reference is made to the following copending patent applications all of which were filed on the same date as the present application, and all of which are incorporated in the present application as if fully set forth herein: Ventilating Dehumidifying System Using A Wheel for both Heat Recovery and Dehumidification, application Ser. No. 09/518,924; Ventilating Dehumidifying System, application Ser. No. 09/519,484; Ventilating Dehumidifying System Using A Wheel Driven by Variable Speed Pulsing Motor, application Ser. No. 09/519,516; Dehumidifier Using Non-Rotating Desiccant Material, application Ser. No. 09/519,870.

BACKGROUND OF THE INVENTION

The present invention relates to air ventilation and an improved air ventilation system which includes the capability of adjusting air pressure within the conditioned space.

ANSI/ASHRAE Standard 62-1989 was established to address the need for increased ventilation of buildings due to poor indoor air quality. Increased levels of contaminants from humans, fuel burning appliances, building materials and furnishings have resulted from current construction practices which produce tighter, low leakage buildings. For example, volatile organic compounds (VOCs) such as formaldehyde have been identified. Continued exposure to VOCs can cause illness. Recommended ventilation rates range from about 0.3 air changes per hour to over 1.0 air changes per hour. The actual level of recommended outdoor air intake depends on the use, size and occupancy of the building.

Homeowners also are becoming more aware of the importance of including air ventilation systems within their homes. In recent years, there is an increasing move toward houses with higher air tightness. Due to insufficient natural ventilation, however, air fouled with tobacco smoke and poisonous emissions from gas burning devices tend to stagnate inside homes. In addition, unless ventilation is sufficient during rainy seasons, dew may be formed on walls, thereby inducing growth of mold. Insufficient ventilation is therefore unsanitary. There exists a need for smaller, less complex, less expensive ventilation systems that are appropriate for residential use.

An additional problem associated with air-tight homes concerns differences in air pressure inside and outside the home. When ventilation systems are installed the builder typically ensures that the system draws as much air into the building as the system removes, thereby keeping the air pressure inside balanced with the air pressure outside. However, problems arise when the inhabitants activate other ventilation systems within the home such bathroom and kitchen fans. When these devices are activated they can produce a pressure drop inside the home and can potentially accumulate harmful gases such as carbon monoxide from open-flame combustion devices like furnaces and stoves. This potentially deadly back-draft of harmful gases could be avoided if the ventilation system could draw in more air than it takes out in order to make-up for other systems removing air from the space.

SUMMARY OF THE INVENTION

In accordance with the present invention there is provided a ventilation system for ventilating fresh air to a conditioned space. The present system is constructed within a unit housing. Passing through the unit housing is an inflow chamber, an outflow chamber, and a make-up air duct. Two blowers, an intake blower and an exhaust blower, are placed within the inflow chamber and the outflow chamber in order to motivate inflow and outflow currents of air. A damper acts to open and close the make-up air duct. When the damper is in an open position and the intake blower operates at a higher speed than the exhaust blower the system increases the air pressure within the conditioned space. A heat transfer wheel is disposed within both the inflow chamber and the outflow chamber to exchange heat between the two currents of air. A pre-heater is placed in the make-up air duct to be used in cold weather conditions to heat the air which bypasses the heat recovery wheel. The present system may also include a desiccant wheel and regenerative heater in order to provide the function of dehumidification. The desiccant wheel is both regenerated and defrosted by a regenerative heater which is positioned to heat the outflow current of air before the outflow current passes through the desiccant wheel. Additionally, the blowers can be arranged so as to create an air pressure differential between the inflow chamber and the outflow chamber so that any leakage of air between the two chambers will occur from the inflow chamber to the outflow chamber.

DETAILED DESCRIPTION

Figure 1:
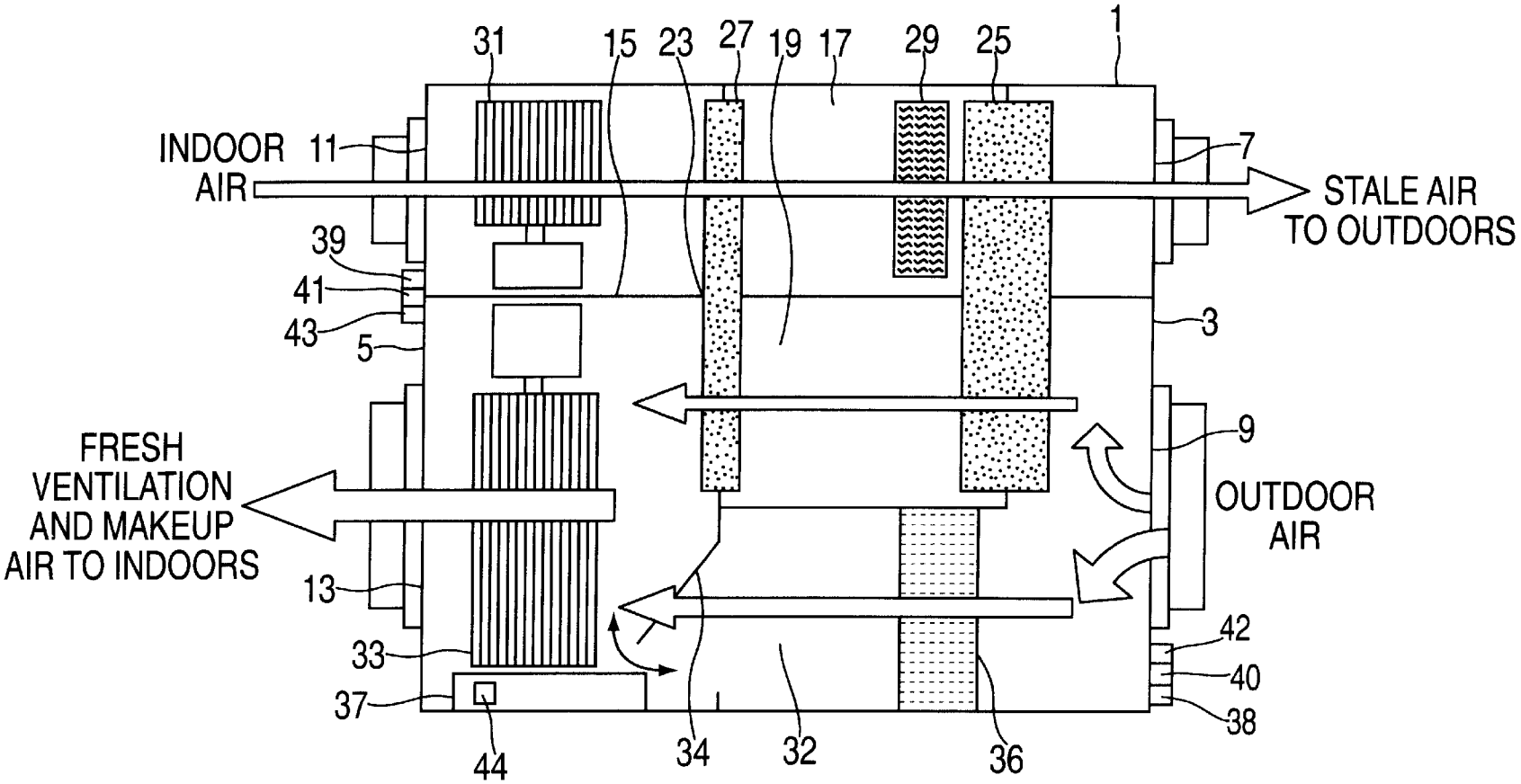
FIG. 1 shows a schematic diagram of one embodiment of the present system.

FIG. 1 shows one preferred embodiment of the present system contained within a single appliance for economically ventilating a conditioned space and for maintaining the air pressure within the conditioned space in equilibrium with the air pressure outside the conditioned space. The system comprises a unit housing 1 typically made of sheet metal or plastic, having both a back panel 3 and a front panel 5. The unit housing 1 is generally rectangular with back panel 3 and front panel 5 making up opposite sides of the rectangular unit housing 1.

Within the back panel 3 there are two apertures, the first aperture being an outdoor exhaust aperture 7, and the second aperture being an outdoor intake aperture 9. The outdoor exhaust aperture 7 is in communication with outdoor air. Alternatively the outdoor exhaust aperture could be in communication with other piping or ductwork which itself would be in communication with outside air. The outdoor intake aperture 9 is also in fluid communication with outdoor air or other ductwork which is itself in communication with outside air. The outdoor exhaust aperture 7 functions as a port through which stale air is expelled from the system to the outside. Meanwhile, the outdoor intake aperture 9 functions as a port through which the system obtains fresh air to be supplied to the conditioned space.

Within the front panel 5 there are two apertures, an indoor intake aperture 11 and an indoor exhaust aperture 13. Both the indoor intake aperture 11 and the indoor exhaust aperture 13 are in fluid communication with the indoor air of the conditioned space or other piping which is itself in communication with indoor air. The indoor intake aperture 11 functions as a port through which stale air from the conditioned space is supplied to the system. The indoor exhaust aperture 13 is a port through which fresh air is supplied from the system to the conditioned space.

Within the interior of the unit housing 1, there is a divider wall 15 which acts with the unit housing 1 and the back panel 3 and the front panel 5 to define an outflow chamber 17 and an inflow chamber 19. The inflow chamber 19 is in fluid communication with the outdoor intake aperture 9 and the indoor exhaust aperture 13 thereby allowing an inflow current of air to flow from the outdoor intake aperture 9 through the inflow chamber 19 and out the indoor exhaust aperture 13. The outflow chamber 17 is in fluid communication with the outdoor exhaust aperture 7 and the indoor intake aperture 11 thereby allowing an outflow current of air to flow from the indoor intake aperture 11 through the outflow chamber 17 and out the outdoor exhaust aperture 7. The divider wall 15 defines at least one wheel aperture 23.

The wheel aperture 23 in the divider wall 15 allows a heat transfer wheel 27 to pass through the divider wall 15. The heat transfer wheel 27 is placed within both the outflow chamber 17 and the inflow chamber 19 so that its axis of rotation is substantially parallel to the flow of both the inflow current of air and the outflow current of air. The heat transfer wheel 27 transfers heat between the inflow and outflow currents of air, one of the currents of air being warmer than the other current. As a portion of the heat transfer wheel 27 passes through the warmer of the two interior chambers 17 and 19, that portion of the wheel gains heat. Subsequently, when the same portion of the heat transfer wheel 27 passes through the cooler of the two chambers, the heat is lost from the wheel to the air flow current of the cooler chamber. Concurrently, cool air is passed from the cooler of the two chambers to warmer chamber via the wheel 27. Therefore, in warm weather the heat transfer wheel 27 transfers heat from the inflow current of air to the outflow current of air, thereby conserving energy necessary to cool the conditioned space. In cold weather the heat transfer wheel 27 transfers heat from the outflow current of air to the inflow current of air, thereby reducing heating costs.

Within the outflow chamber, there is an exhaust blower 31 which moves the outflow current of air from the indoor intake aperture 11, through the outflow chamber 17 and out the outdoor exhaust aperture 7. Similarly, within the inflow chamber 19 there is an intake blower 33 which moves the inflow current of air from the outdoor intake aperture 9 and out the indoor exhaust aperture 13. Blowers 31 and 33 may be configured as squirrel cage blowers, axial fans, propellers and other devices capable of creating a current of air. The size and capacity of blowers 31 and 33 depend upon the system size and configuration. For example in one embodiment, the exhaust blower 31 is capable of moving 200 cubic feet per minute at 0.1 inches of water column pressure, and the intake blower 33 is either a variable speed or a multiple speed blower. The intake blower 33 is normally configured with the capacity to draw into the conditioned space more air than is being removed from the space by the exhaust blower 31. For example, with the exhaust blower having a flow rate of 200 cubic feet per minute, the intake blower may have a flow rate capacity on the order of 600 cubic feet per minute. Fasco Motors Group manufactures blowers suitable for these purposes.

Additionally the blowers 31 and 33 can be arranged (not shown in FIG. 1) so that there exists a pressure bias between the outflow chamber 17 and the inflow chamber 19. By placing the exhaust blower 31 and the intake blower 33 near the back panel 3, the outflow current of air is essentially pulled from the indoor intake aperture 11 to the outdoor exhaust aperture 7, whereas the inflow current of air is pushed from the outdoor intake aperture 9 to the indoor exhaust aperture 13. Because the inflow current of air is pushed through the system while the outflow current of air is sucked through the system, there exists a pressure bias between the inflow and outflow chambers 17 and 19. Such a bias prevents stale, contaminated air from leaking out of the outflow chamber 17 and into the inflow chamber 19. Instead, to the extent there exists openings between the inflow and outflow chamber 17 and 19, the inflow current of air will be forced to leak into the outflow chamber 17 by the difference in air pressures.

The present system typically also comprises a make-up air duct 32 which is in fluid communication with the outdoor intake aperture 9 and the indoor exhaust aperture 13. Within the make-up air duct 32 there preferably is a damper 34 having both an open and a closed position. In the preferred embodiment a simple 24 volt electric motor powers the damper between open and closed positions. Such motors are commercially available. When the damper 34 is closed the system acts as a simple heat recovery ventilator as the inflow current of air passing from outside to inside equals the outflow current of air passing from inside to outside. When the damper is in an open position and the intake blower 33 operates at a higher speed than the exhaust blower 31, the make-up air duct 32 functions as a bypass channel allowing more air to pass into the conditioned space than is being removed by the exhaust blower 31. Therefore, the system is able not only to ventilate the conditioned space, but also to draw more air into the space than is removed by the system. This additional capability of the system prevents the hazards caused when the pressure inside a conditioned space does not equal the outside air pressure.

A pre-heater 36 may also be included in the system in order to temper the temperature of the inflow current of air which bypasses the heat transfer wheel 27. The pre-heater 36 operates in cold weather conditions to preheat outside air before it enters the home while the system operates to balance the air pressure inside the conditioned space. The pre-heater 36 could comprise electric resistor wires or coils, a gas burner, or even hot water elements connected to the household water heater.

In order to power movement of the heat transfer wheel 27, a wheel motor assembly may be included in the system. The preferred speed of rotation depends on the dimensions and configuration of the wheel. For example, for a wheel 14⅛" in diamter that is 3.65" thick, the motor assembly may be capable of rotating the wheel at speeds of about 20 revolutions per minute. A simple electric motor may be used to fulfill the wheel movement. For example, for a wheel as just described, a 120 volt, 0.2 amp AC motor with 75 ounce-inch starting torque may be used in conjunction with a belt assembly or friction rollers to rotate the heat transfer wheel 27. Alternatively, the motor assembly may be configured to rotate the center shaft of the wheel directly. Such motors are commercially available and are known in the art.

As shown in FIG. 1, the present system may also include a rotating desiccant wheel 25 and regenerative heater 29. These additional elements permit the system to function as a dehumidifying, heat recovery ventilator with make-up air capability. The rotating desiccant wheel 25 operates by adsorbing moisture from the inflow current of air within the inflow chamber 19. Then, by rotation the portion of the wheel containing the moisture passes to the outflow chamber 17 where the moisture is released to the outflow current of air. By heating the air before it passes through the desiccant, the regenerative heater 29 encourages release of moisture from the rotating desiccant wheel 25. Warmer air is able to remove more moisture from the wheel 25 than unheated air. As the rotating desiccant wheel 25 spins, it continually adsorbs moisture from the inflow current of air in the inflow chamber 19 and subsequently expels that moisture in the outflow chamber to the outflow air current, thereby dehumidifying the inflow current of air.

The rotating desiccant wheel 25 is typically formed of a substrate on which desiccant material has been coated or impregnated. Substrate examples include fiberglass, paper, aluminum, and titanium. In one preferred embodiment the substrate is formed of fiberglass. The desiccant itself may comprise a silica gel. Desiccant wheels are known in the art and are commercially available. One preferred embodiment uses a Tigel Amorphous Silica Gel Desiccant Wheel Model # 30612-01 manufactured by Munters Corporation. For example, a desiccant wheel 14⅛" in diameter and 3.65" thick is able to remove 100 pints of moisture per day at an outside air temperature of 80° Fahrenheit, at 60% relative humidity, and at an airflow rate of 200 cubic feet per minute. The most efficient speed to rotate the wheel depends upon the size and configuration of the system and the wheel, but for a wheel as just described the efficient speed would be about 20 revolutions per hour.

The regenerative heater 29 is placed near enough the rotating desiccant wheel 25 in order to regenerate or dry the rotating desiccant wheel when in operation. The regenerative heater 29 may be constructed using an electric heating element, hot water elements, or, as in one preferred embodiment, a natural gas burner such as is commonly found in clothes dryers.

The regenerative heater 29 typically is configured and positioned to be able to defrost the desiccant wheel during ventilation. In cold climates, the moisture collecting on the desiccant wheel 25 can become frozen. In such a case, prior art ventilation systems close off the outside air intake and recycle warm interior air through the system until the desiccant wheel defrosts. The present system, however, may be configured to use the heat output of the regenerative heater 29 in order to defrost the desiccant wheel without stopping or interrupting the ventilation process. Both the ventilation and defrost modes of the system can operate simultaneously.

In the embodiment shown in FIG. 1, the rotating heat transfer wheel 27, the regenerative heater 29, the rotating desiccant wheel 25, and the blowers 31 and 33 can be operated independently of each other, thereby allowing several different modes of operation for the system. When the exhaust blower 31 and the intake blower 33 are on and the desiccant wheel 25 and regenerative heater 29 are off and the heat recovery wheel 27 is on, the system will function as a heat recovery ventilator which ventilates the conditioned space and recovers heat in order to save energy. Alternatively, the system can be operated in a second mode where the exhaust blower 31 and the intake blower 33 are on, the desiccant wheel 25 and the regenerative heater are on while the heat transfer wheel 27 is off so that the system functions as a dehumidifier and ventilator with little heat transfer between the inflow current of air and the outflow current of air. In addition, the system can operate in a mode where the intake blower 33 and the exhaust blower 31 are on, the desiccant wheel 25 is on, the regenerative heater 29 is on and the heat recovery wheel 27 is on so that the system functions as a ventilator with dehumidification as well as heat recovery. In addition, the system can operate without either the heat recovery wheel 27 or the rotating desiccant wheel 25 or the regenerative heater 29 on so that the system operates as a simple ventilator. During any of these modes the system can also draw more air into the conditioned space than is removed by opening the damper in the make-up air duct and running the intake blower 33 at a higher speed than the exhaust blower 31.

One embodiment of the present system includes a control panel 37 which would enable the user to select the desired mode from the above modes by turning the various elements on or off as desired.

Another embodiment of the system includes thermisters 38 and 39, RH sensors 40 and 41, and pressure sensors 42 and 43 to measure the temperature, air pressure and humidity inside and outside the conditioned space. The system may also or alternatively be electrically connected to the home thermostat for monitoring indoor air conditions. When coupled to a controller logic unit 44, the present system may be configured to select automatically the preferred operating mode that would most efficiently achieve desired temperature, air pressure and humidity levels.

Acceptable thermisters, RH sensors and pressure sensors are commercially available and can be ordered from Stetron International, Inc., TDK USA Corp., and Tri Delta Industries, Inc. respectively. The controller logic unit may be any programmable microprocessor such as a Motorola HC705, JP7 micro-controller.

The above specification, examples and data provide a description of the manufacture and use of the invention. Many embodiments of the invention can be made without departing from the spirit and scope of the invention as defined by the following claims:

We claim:

1. A system contained within a single appliance for ventilating a conditioned space and maintaining the air pressure within the conditioned space in equilibrium with the air pressure outside the conditioned space comprising:

a unit housing having both a front and back panel wherein the back panel defines an outdoor exhaust aperture and an outdoor intake aperture, the front panel defines an indoor exhaust aperture and an indoor intake aperture;

a divider wall disposed within the unit housing and acting with the unit housing to define an outflow chamber and an inflow chamber, wherein the outflow chamber is in communication with the indoor intake aperture and the outdoor outlet aperture, and wherein the inflow chamber is in communication with the outdoor intake aperture and the indoor outlet aperture; the divider wall further defining a heat transfer wheel aperture;

a makeup air duct in communication with the outdoor intake aperture and the indoor outlet aperture, the air duct including a damper having a closed position and at least one open position;

an exhaust blower disposed within the outflow chamber in order to propel an outflow current of air from the indoor intake aperture through the outflow chamber and through the outdoor outlet aperture;

an intake blower disposed within the unit housing in order to propel an inflow current of air from the outdoor intake aperture through the inflow chamber and out the indoor outlet aperture, and, when the damper of the makeup air duct is in an open position, a makeup current of air from the outdoor intake aperture through the makeup air duct and out the indoor outlet aperture; wherein the intake blower is a variable speed blower and can be operated independently from and at higher speeds than the exhaust blower;

a heat transfer wheel rotatably coupled to a heat wheel motor assembly, wherein the heat transfer wheel is disposed in the wheel aperture of the divider wall and is also disposed within both the inflow chamber and the outflow chamber with its axis of rotation substantially parallel to the movement of both the inflow and outflow currents of air;

wherein the heat transfer wheel intersects both the inflow current of air and the outflow current of air to exchange heat between the inflow and outflow air currents, and wherein the intake blower can operate at a higher speed than the exhaust blower when the makeup air duct damper is in an open position to provide more air to the conditioned space than is exhausted by the exhaust blower, whereby the system works as a single appliance to ventilate the conditioned space with heat recovery and to provide makeup air to the conditioned space in order to equalize the air pressure in the conditioned space with the air pressure outside the conditioned space.

2. The system of claim 1 further comprising a pre-heater disposed within the makeup air duct to temper the temperature of the makeup current of air so as to reduce heat loss from the conditioned space when equalizing air pressure inside the conditioned space with air pressure outside the conditioned space.

3. The system of claim 1 further comprising:

a rotatable desiccant wheel, the desiccant wheel being disposed within the inflow and outflow chambers with its axis of rotation substantially parallel to the movement of both the inflow and outflow currents of air; a regenerative heater disposed within the outflow chamber to increase regeneration of the desiccant wheel and to defrost the desiccant wheel;

wherein said desiccant wheel intersects both the inflow current of air and the outflow current of air to exchange moisture between the inflow and outflow air currents;

whereby the system operates as a dehumidifying, heat recovery ventilator with pressure equalization capabilities; and further whereby the regenerative heater is capable of defrosting the desiccant wheel without interrupting the ventilating function of the system.

4. The system of claim 3 wherein the system further comprises a control panel adjustable to operate the system in the following modes:

(a) exhaust blower ON, intake blower ON at balanced speed, damper in closed position, rotating desiccant wheel OFF, heat transfer wheel ON so that the system functions as a heat recovery ventilator without makeup current;

(b) exhaust blower ON, intake blower ON at a speed faster than exhaust blower, damper in an open position, rotating desiccant wheel OFF, heat transfer wheel ON so that the system functions as a heat recovery ventilator with makeup current;

(c) exhaust blower ON, intake blower ON at balanced speed, damper in closed position, rotating desiccant wheel ON, heat transfer wheel OFF so that the system functions as a dehumidifier and ventilator with little heat transfer between the inflow current of air and the outflow current of air and without makeup current;

(d) exhaust blower ON, intake blower ON at a speed faster than exhaust blower, damper in an open position, rotating desiccant wheel ON, heat transfer wheel OFF so that the system functions as a dehumidifier and ventilator with little heat transfer between the inflow current of air and the outflow current of air and with makeup current;

(e) exhaust blower ON, intake blower ON at balanced speed, damper in closed position, rotating desiccant wheel ON, heat transfer wheel ON so that the system functions as a dehumidifier and as a heat recovery ventilator;

(f) exhaust blower ON, intake blower ON at a speed faster than exhaust blower, damper in an open position, rotating desiccant wheel ON, heat transfer wheel ON so that the system functions as a dehumidifier and as a heat recovery ventilator with makeup current;

(g) exhaust blower ON, intake blower ON at balanced speed, damper in closed position, rotating desiccant wheel OFF, heat transfer wheel OFF so that the system functions as only a ventilator;

(h) exhaust blower ON, intake blower ON at a speed faster than exhaust blower, damper in an open position, rotating desiccant wheel OFF, heat transfer wheel OFF so that the system functions as a ventilator with makeup current;

(i) blowers OFF, rotating desiccant wheel OFF, heat transfer wheel OFF;

(j) intake blower ON, exhaust blower OFF, damper in an open position, rotating desiccant wheel OFF, heat transfer wheel OFF so that the system functions only to direct makeup current into conditioned space;

whereby the ventilation function of the system can be employed with or without heat recovery, with or without dehumidification, and with or without air pressure equalization.

5. The system of claim 1 wherein the system further comprises a control panel adjustable to operate the system in the following modes:

(a) exhaust blower ON, intake blower ON at balanced speed, damper in closed position, heat transfer wheel ON so that the system functions as a heat recovery ventilator without makeup current;

(b) exhaust blower ON, intake blower ON at a speed faster than exhaust blower, damper in an open position, heat transfer wheel ON so that the system functions as a heat recovery ventilator with makeup current;

(c) exhaust blower ON, intake blower ON at balanced speed, damper in closed position, heat transfer wheel OFF so that the system functions as a ventilator with little heat transfer between the inflow current of air and the outflow current of air and without makeup current;

(d) exhaust blower ON, intake blower ON at a speed faster than exhaust blower, damper in an open position, heat transfer wheel OFF so that the system functions as a ventilator with little heat transfer between the inflow current of air and the outflow current of air and with makeup current;

(i) blowers OFF, heat transfer wheel OFF;

(j) intake blower ON, exhaust blower OFF, damper in an open position, heat transfer wheel OFF so that the system functions only to direct makeup current into conditioned space;

whereby the ventilation function of the system can be employed with or without heat recovery, and with or without air pressure equalization.

6. The system of claim 5 further comprising a means for measuring temperature, humidity and air pressure both inside and outside the conditioned space.

7. The system of claim 6 further comprising a controller logic unit for selecting a preferred operating mode based on a set of input criteria, the temperature, humidity and the air pressure both inside and outside the conditioned space;

whereby the system operates automatically to select the preferred operating mode that will best achieve the set of input criteria.

8. The system of claim 4 further comprising a means for measuring temperatures, humidity, and air pressures both inside and outside the conditioned space.

9. The system of claim 8 further comprising a controller logic unit for selecting a preferred operating mode based on a set of input criteria, the temperature, the humidity, and the air pressures both inside and outside the conditioned space;

whereby the system operates automatically to select the preferred operating mode that will best achieve the set of input criteria.

10. The system of claim 1 wherein the exhaust blower can operate at an air flow capacity on the order of 200 cubic feet per minute and the intake blower can operate at an air flow capacity on the order of 600 cubic feet per minute.

11. The system of claim 1 wherein the intake and exhaust blowers are arranged within the inflow and outflow chambers to produce an air pressure bias between the chambers such that the inflow chamber is at a higher air pressure than the outflow chamber when both blowers are operating at the same speed;

whereby the system prevents leakage of stale, contaminated air from the outflow chamber to the inflow chamber.

12. The system of claim 1 wherein the system is capable of ventilating and at a rate of at least 100 cubic feet per minute.

13. The system of claim 1 wherein the system is capable of ventilating at a rate of at least 200 cubic feet per minute.

* * * * *